US006690898B2

(12) United States Patent
Nishiwaki

(10) Patent No.: US 6,690,898 B2
(45) Date of Patent: Feb. 10, 2004

(54) IMAGE FORMING APPARATUS WITH MOVABLE CLEANING ELEMENT

(75) Inventor: Kenjiro Nishiwaki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/289,376

(22) Filed: Nov. 7, 2002

(65) Prior Publication Data

US 2003/0091364 A1 May 15, 2003

(30) Foreign Application Priority Data

Nov. 9, 2001 (JP) ..... 2001-345168

(51) Int. Cl.[7] ..... G03G 12/10
(52) U.S. Cl. ..... 399/101; 399/345
(58) Field of Search ..... 399/99, 101, 302, 399/308, 345, 349; 15/256.51, 256.52, 256.53

(56) References Cited

U.S. PATENT DOCUMENTS 4,931,839 A * 6/1990 Tompkins et al. ..... 399/101
5,083,169 A * 1/1992 Usui et al. ..... 399/345
5,678,134 A * 10/1997 Miki et al. ..... 399/349
5,729,788 A * 3/1998 Hirohashi et al. ..... 399/101
6,167,215 A * 12/2000 Miyashiro et al. ..... 399/308
6,226,489 B1 * 5/2001 Eelen et al. ..... 399/327
6,269,228 B1 * 7/2001 Kayahara et al. ..... 399/302

FOREIGN PATENT DOCUMENTS

JP 57203270 A * 12/1982 ..... G11B/23/50
JP A 2000-267458 9/2000

* cited by examiner

*Primary Examiner*—Sophia S. Chen
*Assistant Examiner*—Ryan Gleitz
(74) *Attorney, Agent, or Firm*—Oliff & Berridge, PLC

(57) ABSTRACT

A color laser printer includes a second cleaner, that has a second cleaning roller, a second cleaning box, a second removing roller and a waste toner storage portion, in its casing. In the color laser printer, only the second cleaning roller, which captures toner remaining on an intermediate transfer belt, moves to contact and separate from the intermediate transfer belt while the second cleaning box, the second removing roller and the waste toner storage portion are fixed to the casing of the color laser printer. Therefore, the structure of the color laser printer is simplified, thereby reducing its manufacturing cost.

30 Claims, 6 Drawing Sheets

IMAGE FORMING APPARATUS WITH MOVABLE CLEANING ELEMENT

BACKGROUND OF THE INVENTION

1. Field of Invention

The invention relates to an apparatus that forms an image using toners of a plurality of colors, like a color laser printer.

2. Description of Related Art

There has been a color laser printer that includes a plurality of developing rollers to hold different color toner respectively, a photosensitive medium, an intermediate transfer medium and a transfer roller, mounted in a casing.

First, a color-by-color visible image is sequentially formed on the photosensitive medium then transferred to the intermediate transfer medium by sequentially using yellow, magenta, cyan and black toners held on the respective developing rollers. Thus, a color image is formed on the intermediate transfer medium. The color image is transferred onto a sheet by the transfer roller, and finally, a color image is formed on the sheet.

The color laser printer further includes a cleaning unit that captures toner, which remains on the intermediate transfer medium without being transferred onto the sheet.

The cleaning unit generally includes a cleaning roller that contacts the intermediate transfer medium, a removing roller that contacts the cleaning roller, a wiping blade that contacts the removing roller and a waste toner storage box. When a predetermined bias is applied to the cleaning roller, the toner held on the intermediate transfer medium is captured by the cleaning roller and electrically held thereon. When a predetermined bias is applied to the removing roller, the toner held on the cleaning roller is electrically captured and held on the removing roller. Then, the toner remaining on the removing roller is wiped by the wiping blade, and stored in the waste toner storage box.

The cleaning unit is designed so as to contact and separate from the intermediate transfer medium. The cleaning unit is out of contact with the intermediate transfer medium until a color image is formed onto the intermediate transfer medium. After the color image is transferred onto the sheet, the cleaning unit contacts the intermediate transfer medium to remove the toner remaining on the intermediate transfer medium.

However, if the cleaning roller, the removing roller, the wiping blade and the waste toner storage box are unitized so as to integrally contact and separate from the intermediate transfer medium, the structure for the mechanism is complicated, thereby increasing manufacturing costs.

SUMMARY OF THE INVENTION

The inventions described in the following embodiments are made to improve the above-identified related art.

The image forming apparatus of the invention includes a developer cartridge that contains developer, an image holding element that holds the developer, which is supplied from the developer cartridge, to form a visible image, an intermediate transfer element on which the visible image is transferred, a cleaning element that captures the developer from the intermediate transfer element, a removing member that removes the developer from the cleaning element and a mechanism that leaves the cleaning element so as to contact and separate from the intermediate transfer element and contact and separate from the removing member.

According to one aspect of the invention, only the cleaning element is brought into contact with and separated from the intermediate transfer element and the removing member. Thus, the structure of the image forming apparatus can be simplified as compared with that of the related art and manufacturing costs can be reduced.

BRIEF DESCRIPTION OF THE DRAWINGS

Exemplary embodiments of the invention will be described in detail with reference to the following figures wherein.

DETAILED DESCRIPTION OF PREFERRED EMBODIMENTS

Figure 1:
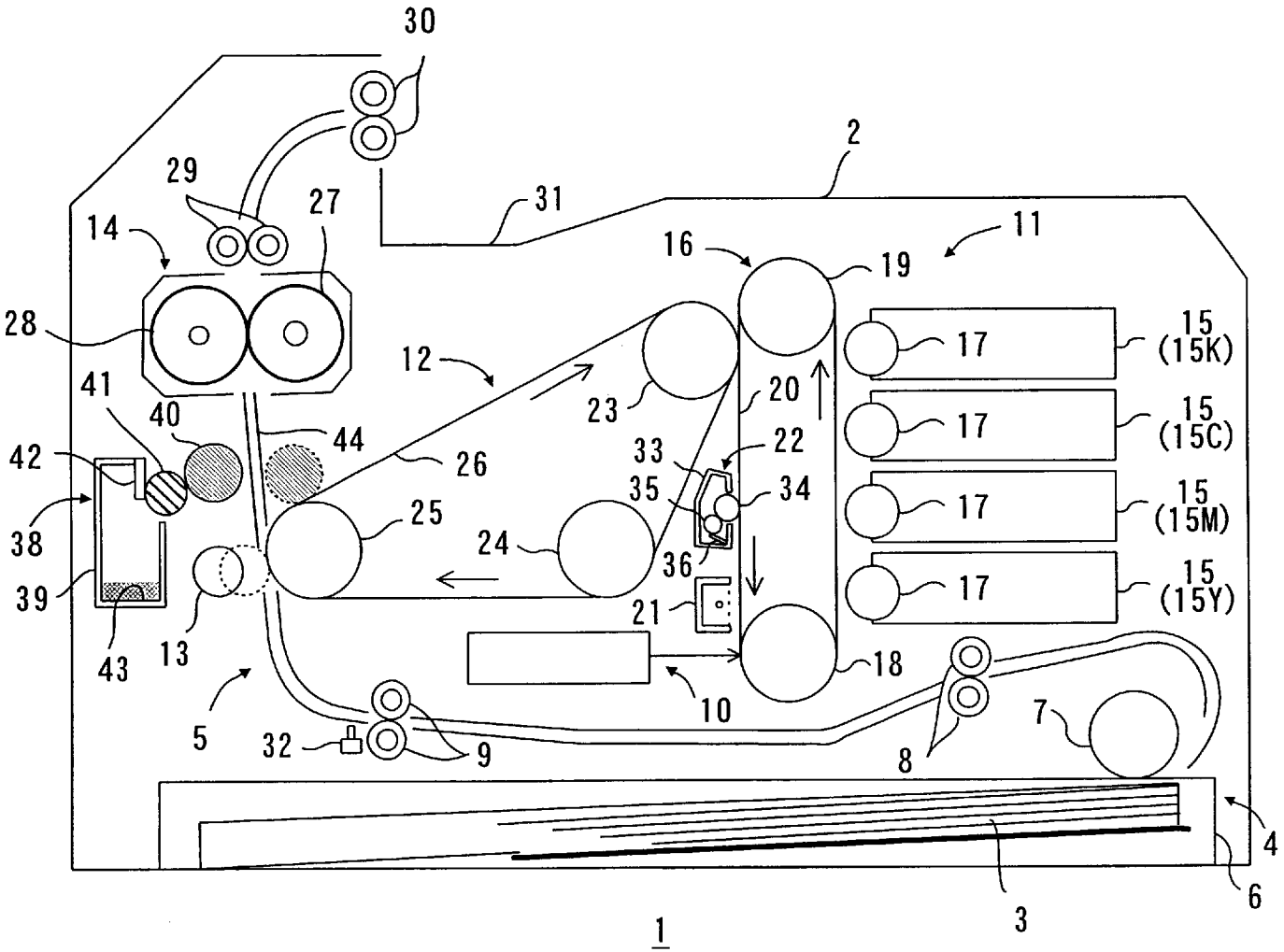
FIG. 1 is a side sectional view of essential parts of a color laser printer.

As shown in FIG. 1, a color laser printer 1 includes a sheet feed unit 4, for feeding a sheet 3, and an image forming unit 5, for forming a predetermined image onto the sheet 3, in a casing 2.

The sheet feed unit 4 includes a sheet tray 6 and a sheet feed roller 7. The sheet tray 6, provided in the sheet feed unit 4, contains a stack of sheets 3 therein. An uppermost sheet 3 in the sheet tray 6 is fed from the stack, one by one, by rotation of the sheet feed roller 7. Then, the sheet 3 is conveyed to the image forming unit 5 by conveying rollers 8 and resist rollers 9.

Figure 2:
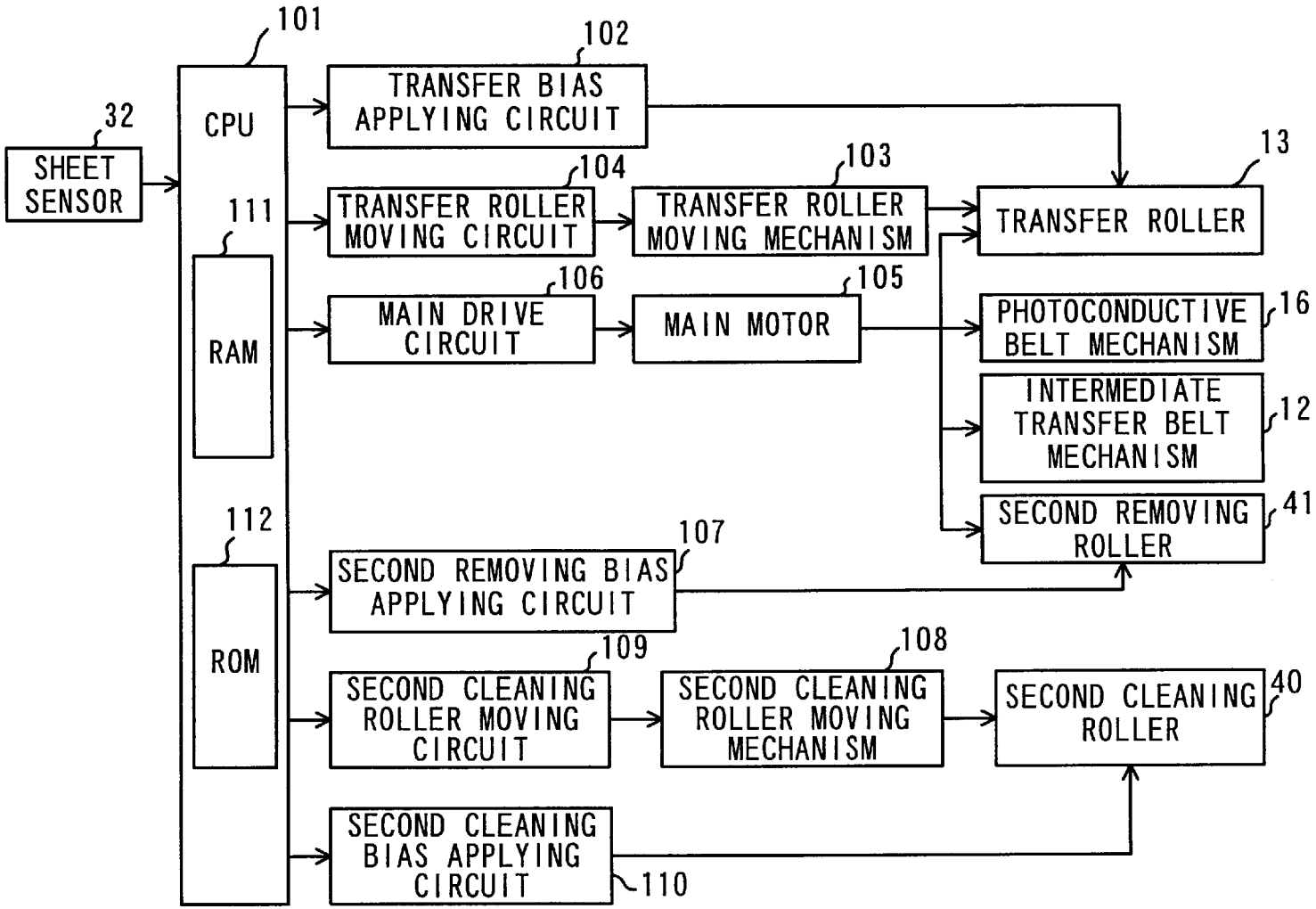
FIG. 2 is a block diagram showing a control system of the color laser printer of FIG. 1.

A sheet sensor 32 is disposed near and downstream of the resist rollers 9 in a sheet feed direction. The sheet sensor 32 sends a detection signal indicating passage of a leading edge of the sheet 3 to a CPU 101 (FIG. 2).

The image forming unit 5 includes a scanning unit 10, a processing unit 11, an intermediate transfer belt mechanism 12, a transfer roller 13, and a fixing unit 14.

The scanning unit 10 is provided substantially in the center of the casing 2 and includes a laser emitting portion (not shown), a polygon mirror (not shown), a plurality of lenses (not shown), and reflectors (not shown). A laser beam emitted from the laser emitting portion is modulated based on image data. The laser beam emitted from the laser emitting portion passes to and is reflected by the polygon mirror, thence to the reflectors and the lens, and irradiates a surface of a photosensitive belt 20 (described later).

The processing unit 11 includes four developing cartridges 15 and a photosensitive belt mechanism 16. The developing cartridges 15 include a yellow toner cartridge 15Y, a magenta toner cartridge 15M, a cyan toner cartridge 15C, and a black toner cartridge 15K for storing yellow, magenta, cyan, and black toners, respectively. The developing cartridges 15Y, 15M, 15C, 15K are aligned, in this order from below, in the rear part of the casing 2. The developing cartridges 15Y, 15M, 15C, 15K are provided in parallel to each other, at regular intervals, in the vertical direction.

All of the developing cartridges 15Y, 15M, 15C, 15K have the same structure, so that only one of the developing cartridges 15Y, 15M, 15C, 15K will be described below. The developing cartridge 15 includes a developing roller 17, a layer thickness-regulating blade (not shown), a supply roller (not shown) and a toner box (not shown). The developing cartridge 15 can be moved in the horizontal direction by a solenoid (not shown). By moving the developing cartridge 15 in the horizontal direction, the developing roller 17 can be brought into contact with and separated from the photosensitive belt 20.

Each developing roller 17 is a metal shaft covered with a conductive elastic material. The elastic material for the developing roller 17 includes a conductive elastic member including carbon particles and a coating layer that covers the conductive elastic member. The conductive elastic member is made of a material, such as urethane rubber, silicone rubber, or EPDM rubber. The coating layer is made of mainly, for example, urethane rubber, urethane resin, or polyimide resin.

A developing bias is applied to the developing roller 17 to generate a predetermined electric field between the developing roller 17 and the photosensitive belt 20.

The toner boxes provided in the developing cartridges 15Y, 15M, 15C, 15K contain toner of the respective colors of yellow, magenta, cyan, and black. The toner has a spherical shape and is positively electrically charged polymerized toner of a single non-magnetic component. The toner is supplied from the toner box to the developing roller 17 by rotation of the supply roller. At that time, the toner becomes positively charged by friction caused between the supply roller and the developing roller 17. The toner supplied to the developing roller 17 enters between the layer thickness-regulating blade and the developing roller 17 by the rotation of the developing roller 17 and is further charged by friction therebetween. Thus, the toner held by the developing roller 17 is limited to a certain thickness.

The photosensitive belt mechanism 16 is disposed in front of and at the side of the developing cartridge 15Y, 15M, 15C, 15K. The photosensitive belt mechanism 16 includes first and second photosensitive belt rollers 18, 19, the photosensitive belt 20, a charging device 21, and a first cleaner 22. The first photosensitive belt roller 18 is disposed so as to be substantially opposite to the yellow toner cartridge 15Y located at the lowermost position. The second photosensitive belt roller 19 is disposed above the first photosensitive belt roller 18 so as to be substantially opposite to the black toner cartridge 15K located at the uppermost position. The photosensitive belt 20 is wound around the first and second photosensitive belt rollers 18, 19.

The photosensitive belt 20 is an endless belt made by evaporating a thin aluminum layer onto a surface of a PET (polyethylene terephthalate) film and then an organic photosensitive layer is coated on the aluminum layer.

As a main motor 105 (FIG. 2) is driven, the second photosensitive belt roller 19 rotates and the first photosensitive belt roller 18 rotates, following the rotation of the second photosensitive belt roller 19. The photosensitive belt 20 goes around the first and second photosensitive belt rollers 18, 19 in a counterclockwise direction. The photosensitive belt 20 contacts an intermediate transfer belt 26 near the second photosensitive belt roller 19.

The charging device 21 is disposed upstream of a position where the photosensitive belt 20 is exposed by the scanning unit 10, in a rotation direction of the photosensitive belt 20. The charging device 21 faces the photosensitive belt 20 at a predetermined distance therefrom so as not to make contact therewith. The charging device 21 is a scorotron charging device that generates a corona discharge using tungsten wires and uniformly and positively charges the surface of the photosensitive belt 20.

The surface of the photosensitive belt 20 is uniformly positively charged by the charging device 21, and then exposed by a laser beam emitted from the scanning unit 10. Thus, an electrostatic latent image is formed on the surface of the photosensitive belt 20 based on image data.

Then, when the developing roller 17 contacts the photosensitive belt 20, having the latent image thereon, the toner held on the developing roller 17 adheres to the latent image on the photosensitive belt 20 and, thus, a monochrome, visible image is formed on the photosensitive belt 20.

The first cleaner 22 is disposed upstream of the charging device 21 and downstream of a portion at which the photosensitive belt 20 and the intermediate belt 26 are opposed to each other, in the rotation direction of the photosensitive belt 20. The first cleaner 22 includes a first cleaning box 33, a first cleaning roller 34, a first removing roller 35 and a first cleaning blade 36.

The first cleaning box 33, having a box shape, has an opening in a side facing the photosensitive belt 20. A space is provided at a bottom of the cleaning box 33.

The first cleaning roller 34 comprises a metal shaft member covered with an elastic member, such as silicone rubber. The first cleaning roller 34 is rotatably supported at the opening of the first cleaning box 33 so as to contact the photosensitive belt 20. A first cleaning bias is applied to the first cleaning roller 34 to generate a predetermined electric field between the first cleaning roller 34 and the photosensitive belt 20.

The first removing roller 35 is a metal roller, which is disposed in the first cleaning box 33 so as to be opposite to the photosensitive belt 20 while sandwiching the first cleaning roller 34 therebetween. The first removing roller 35 is in contact with the first cleaning roller 34. A first removing bias is applied to the first removing roller 35 to generate a predetermined electric field between the first removing roller 35 and the first cleaning roller 34.

The first cleaning blade 36 has a thin plate shape, which is provided in the first cleaning box 33 so as to press against the first removing roller 35 to wipe toner, which adheres to the first removing roller 35.

After the toner is transferred to the intermediate transfer belt 26, some toner may remain on the photosensitive belt 20. Therefore, the remaining toner is electrically captured by the first cleaning roller 34 when the portion having the toner of the photosensitive belt 20 faces and contacts the first cleaning roller 34. Then, the toner on the first cleaning roller 34 is electrically captured by the first removing roller 35 when the portion having the toner of the first cleaning roller 34 faces and contacts the first removing roller 35 during rotation of the first cleaning roller 34. After that, the toner captured by the first removing roller 35 is wiped by the first cleaning blade 36 by the rotation of the first removing roller 35, and then stored in the space provided in the first cleaning box 33.

The intermediate transfer belt mechanism 12 is disposed in front of and at the side of the photosensitive belt mechanism 16 and includes a first intermediate transfer belt roller 23, a second intermediate transfer belt roller 24, a third intermediate transfer belt roller 25 and the intermediate transfer belt 26. The second intermediate transfer belt roller 24 is disposed diagonally to the lower front of the first intermediate transfer belt roller 23. The third intermediate transfer belt roller 25 is disposed in front of and at the side of the second intermediate transfer belt roller 24. The photosensitive belt 26 is wound around the first, second and third intermediate transfer belt rollers 24, 25, 26.

The first intermediate transfer belt roller 23 is disposed to be substantially opposite to the second photosensitive belt roller 19 while sandwiching the photosensitive belt 20 and the intermediate transfer belt 26 therebetween. The third intermediate transfer belt roller 25 is disposed so as to be opposite to the transfer roller 13 while the intermediate transfer belt 26 is passed therebetween.

The photosensitive belt 26 is an endless belt made of resin, such as polycarbonate and polyimide, having conductivity, in which conductive particles, such as carbon, are dispersed.

The first, second and third photosensitive belt rollers 23, 24, 25 are disposed so as to substantially take the form of a triangle. The photosensitive belt 26 is wound around the first, second and third photosensitive belt rollers 23, 24, 25. The first intermediate transfer belt roller 23 is driven by the main motor 105. The second and third intermediate transfer belt rollers 24, 25 are following rollers, which are rotated as the intermediate transfer belt 26 is rotated by rotation of the first intermediate transfer belt roller 23 driven by the main motor 105. Thus, the intermediate transfer belt 26 goes around the first, second and third intermediate transfer belt rollers 23, 24, 25 in a clockwise direction.

The transfer roller 13 is rotatably provided so as to be opposite to the third intermediate transfer belt roller 25 while the intermediate transfer belt 26 passes therebetween. The transfer roller 13 is a metal shaft covered with a conductive rubber material. The transfer roller 13 can be moved, by a transfer roller moving mechanism 103 (FIG. 2), between a standby position (indicated by a solid line in FIG. 1) where the transfer roller 13 is located a short distance from the intermediate transfer belt 26 and a transfer position (indicated by a dashed line in FIG. 1) where the transfer roller 13 is proximate and opposed to the intermediate transfer belt 26. The transfer roller moving mechanism 103 moves the transfer roller 13 so as to approach and separate from the intermediate transfer belt 26. When the transfer roller 13 is located at the transfer position, the transfer roller 13 and the intermediate transfer belt 26 allow the sheet 3 to pass therebetween.

When the transfer roller 13 is placed at the transfer position, a transfer bias is applied to the transfer roller 13 by a transfer bias applying circuit 102 (FIG. 2) to generate a predetermined electric field between the transfer roller 13 and the intermediate transfer belt 26.

A visible image is sequentially formed, color by color, on the surface of the photosensitive belt 20, and then, transferred onto the intermediate transfer belt 26 one by one.

More specifically, first, the yellow toner cartridge 15Y is moved forward in the horizontal direction by the solenoid to contact the developing roller 17 of the yellow toner cartridge 15Y with the photosensitive belt 20. At that time, the magenta, cyan, and black toner cartridges 15M, 15C, 15K are moved, or maintained, rearward in the horizontal direction by the solenoid to be distanced from the photosensitive belt 20.

Then, only the developing roller 17 of the yellow toner cartridge 15Y contacts the photosensitive belt 20, so that the yellow toner contained in the yellow toner cartridge 15Y is supplied to the photosensitive belt 20 via the developing roller 17. Thus, the yellow toner adheres to the electrostatic latent image formed on the photosensitive belt 20 and an yellow visible image is formed thereon.

When the yellow visible image faces and contacts the intermediate transfer belt 26 by the rotation of the photosensitive belt 20, the yellow visible image is transferred to the intermediate transfer belt 26. However, some toner may remain on the photosensitive belt 20 without transfer to the intermediate transfer belt 26. The yellow toner, which remains on the photosensitive belt 20, is removed from the photosensitive belt 20 by the first cleaner 22.

After that, an electrostatic latent image for magenta is formed on the photosensitive belt 20. Likewise, the magenta toner cartridge 15M is moved forward in the horizontal direction by the solenoid. At that time, the yellow, cyan, and black toner cartridges 15Y, 15C, 15K are moved, or maintained, rearward in the horizontal direction by the solenoid to be distanced from the photosensitive belt 20.

Then, only the developing roller 17 of the magenta toner cartridge 15M contacts the photosensitive belt 20, so that the magenta toner contained in the magenta toner cartridge 15M is supplied to the photosensitive belt 20 via the developing roller 17. Thus, the magenta toner adheres to the electrostatic latent image formed on the photosensitive belt 20 and a magenta visible image is formed thereon.

When the magenta visible image faces and contacts the intermediate transfer belt 26 by the rotation of the photosensitive belt 20, the magenta visible image is transferred to the intermediate transfer belt 26 so as to overlay on the yellow visible image. However, some toner may remain on the photosensitive belt 20 without transfer to the intermediate transfer belt 26. The magenta toner, which remains on the photosensitive belt 20, is removed from the photosensitive belt 20 by the first cleaner 22.

The same procedures are performed using cyan and black toners stored in the cyan toner cartridge 15C and in the black toner cartridge 15K, respectively. As a result, a full-color image, in which the yellow, magenta, cyan, and black toners are overlapped one upon the other, is formed on the intermediate transfer belt 26.

While each visible image is transferred onto the intermediate transfer belt 26, the transfer roller 13 is located at the standby position. When a full-color image is formed on the intermediate transfer belt 26, the transfer roller 13 is moved to the transfer position.

The full-color image formed on the intermediate transfer belt 26 is transferred onto the sheet 3 by the transfer bias, which is applied to the transfer roller 13, while the sheet 3 passes between the intermediate transfer belt 26 and the transfer roller 13.

The fixing unit 14 is provided at the side of and above the intermediate transfer belt mechanism 12, and includes a heat roller 27, an urging roller 28 that presses against the heat roller 27, and a pair of conveying rollers 29 that are provided downstream of the heat roller 27 and the urging roller 28 in the sheet feed direction. The heat roller 27 is a hollow roller which is made of metal, such as aluminum, and covered with silicone rubber. The heat roller 27 has a halogen lamp therein as a heating element.

While the sheet 3 passes between the heat roller 27 and the urging roller 28, the toner forming the color image on the sheet 3 is melted by the heat of the heat roller 27, and is fixed onto the sheet 3 by the urging force from the urging roller 28.

The sheet 3, on which the color image is fixed by the fixing unit 14, is conveyed to a pair of discharge rollers 30 by the conveying rollers 29, and then the sheet 3 is ejected onto an output tray 31 provided at the top of the casing 2.

Some toner may remain on the surface of the intermediate transfer belt 26 without transfer to the sheet 3. The toner, which remains on the surface of the intermediate transfer belt 26, is collected by a second cleaner 38.

The second cleaner 38 is disposed in front of and at the side of the intermediate transfer belt mechanism 12. The second cleaner 38 includes a second cleaning box 39, a second cleaning roller 40 as a cleaning element, a second removing roller 41 as a removing roller, and a second cleaning blade 42.

The second cleaning box 39 is disposed at the side of the intermediate transfer belt mechanism 12 so as to be opposite to the intermediate transfer belt mechanism 12, sandwiching a sheet transfer path 44 therebetween. The second cleaning box 39, having a box shape, has an opening in a wall facing the intermediate transfer belt 26. A space provided at the bottom of the second cleaning box 39 is used as a waste toner storage portion 43 for storing toner wiped by the second cleaning blade 42.

The second cleaning roller 40 is a metal shaft member covered with an elastic member, such as silicone rubber, and is rotatably supported downstream of the transfer roller 14 in the sheet feed direction.

The second cleaning roller 40 can be moved, by a second cleaning roller moving mechanism 108 (FIG. 2), between a toner disposal position (indicated by a solid line in FIG. 1) where the second cleaning roller 40 is distanced from the intermediate transfer belt 26 and contacts the second removing roller 41 and a cleaning position (indicated by a dashed line in FIG. 1) where the second cleaning roller 40 is distanced from the second removing roller 41 and contacts the intermediate transfer belt 26. The second cleaning roller moving mechanism 108 moves the second cleaning roller 40 so as to contact with and separate from the intermediate transfer belt 26 and the second removing roller 41.

The toner disposal position and the cleaning position are provided on both sides of the sheet transfer path 44 of the sheet 3 so as to be opposite to each other. The cleaning position is located downstream of a position where the transfer roller 13 and the third intermediate transfer belt roller 25 face each other and upstream of a position where the photosensitive belt 20 contacts the intermediate transfer belt 26, in the rotation direction of the intermediate transfer belt 26. The cleaning position is provided near the third intermediate transfer belt roller 25.

A second cleaning bias is applied to the second cleaning roller 40 by a second cleaning bias applying circuit 110 (FIG. 2) to generate a predetermined electric field between the second cleaning roller 40 and the intermediate transfer belt 26. The second removing roller 41 is a metal roller and is rotatably supported at the opening of the second cleaning box 39. The second removing roller 41 is rotated by the main motor (FIG. 2).

A second removing bias is applied to the second removing roller 41 by a second removing bias applying circuit 107 (FIG. 2) to generate a predetermined electric field between the second removing roller 41 and the second cleaning roller 40.

The second cleaning blade 42 is provided at the opening of the second cleaning box 39. The second cleaning blade 42 is disposed so as to be opposite to the second cleaning roller 40, sandwiching the second removing roller 41 therebetween. The second cleaning blade 42 is in contact with the second removing roller 41 from above. The second cleaning blade 42 is a thin plate member that wipes toner, which adheres to the surface of the second removing roller 41.

A control system for controlling the second cleaner 38 will be described with reference to FIG. 2. As shown in FIG. 2, the sheet sensor 32 is connected with the CPU 101. The CPU 101 is also connected with the transfer bias applying circuit 102, a transfer roller moving circuit 104 for controlling the transfer roller moving mechanism 103, a main drive circuit 106 for controlling the main motor 105, the second removing bias applying circuit 107, a second cleaning roller moving circuit 109 for controlling the second cleaning roller moving mechanism 108, and the second cleaning bias applying circuit 110.

The CPU 101 includes a RAM 111 and a ROM 112 and controls various portions. The RAM 111 temporarily stores numerical values obtained from the sheet sensor 32 to control the various portions. The ROM 112 stores various control programs, such as a main drive control program, for controlling the transfer bias applying circuit 102, the transfer roller moving circuit 104, the main drive circuit 106, the second removing bias applying circuit 107, the second cleaning roller moving circuit 109, and the second cleaning bias applying circuit 110.

An output of the transfer bias applying circuit 102 is connected with the shaft of the transfer roller 13. The CPU 101 controls the transfer bias applying circuit 102, according to the main drive control program stored in the ROM 112, to control on and off of the application of the transfer bias to the transfer roller 13.

The transfer roller moving mechanism 103 is connected to the transfer roller moving circuit 104. The transfer roller 13 is connected to the transfer roller moving mechanism 103.

The CPU 101 controls the transfer roller moving circuit 104, according to the main drive control program stored in the ROM 112, to control the transfer roller moving mechanism 103. That is, the positional movement of the transfer roller 13 is controlled by the main drive control program. The transfer roller moving mechanism 103 can be a solenoid or a cam mechanism.

The main motor 105 is connected to the main drive circuit 106. The main motor 105 is connected with the transfer roller 13, the photosensitive belt mechanism 16, the intermediate transfer belt mechanism 12 and the second removing roller 41, via a gear train (not shown). The main motor 105 is also connected with other drivers in the color laser printer 1.

The CPU 101 controls the main drive circuit 106, according to the main drive control program stored in the ROM 112, to control the operation (driving and stopping) of the main motor 105. That is, the transfer roller 13, the photosensitive belt mechanism 16, the intermediate transfer belt mechanism 12 and the second removing roller 41 are controlled by the main drive control program.

An output of the second removing bias applying circuit 107 is connected to the shaft of the second removing roller 41. The CPU 101 controls the second removing bias applying circuit 107, according to the main drive control program store in the ROM 112, to control on and off of the application of the second removing bias to the second removing roller 41.

The second cleaning roller moving circuit 109 is connected with the second cleaning roller moving mechanism 108. The second cleaning roller 40 is connected with the second cleaning roller moving mechanism 108.

The CPU 101 controls the second cleaning roller moving circuit 109, according to the main drive control program stored in the ROM 102, to control the second cleaning roller moving mechanism 108. That is, the positional movement of the second cleaning roller 40 is controlled by the main drive control program. The second cleaning roller moving mechanism 108 can be a solenoid or a cam mechanism.

An output of the second cleaning bias applying circuit 110 is connected to the shaft of the second cleaning roller 40. The CPU 101 controls the second cleaning bias applying circuit 110, according to the main drive control program stored in the ROM 112, to control on and off of the application of the second cleaning bias to the second cleaning roller 40.

As described above, the CPU 101 controls the transfer bias applying circuit 102, the transfer roller moving circuit 104, the main drive circuit 106, the second removing bias applying circuit 107, the second cleaning roller moving circuit 109, and the second cleaning bias applying circuit 110, according to the main drive control program, to control a timing of moving the transfer roller 13 and the second cleaning roller 40 and the on and off of the application of the second removing bias and the second cleaning bias.

Figure 3A:
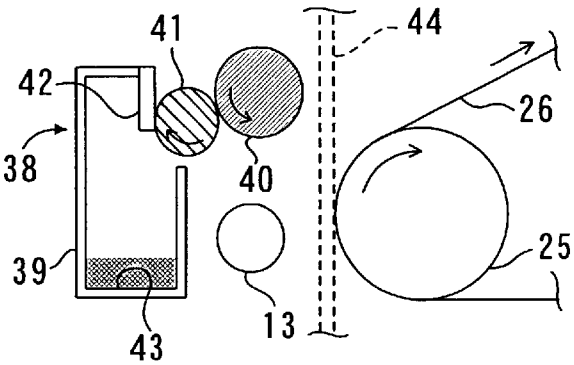
FIGS. 3A and 3B are diagrams showing the area of a second cleaner, of a first embodiment, for the color laser printer of FIG. 1.
Figure 3B:
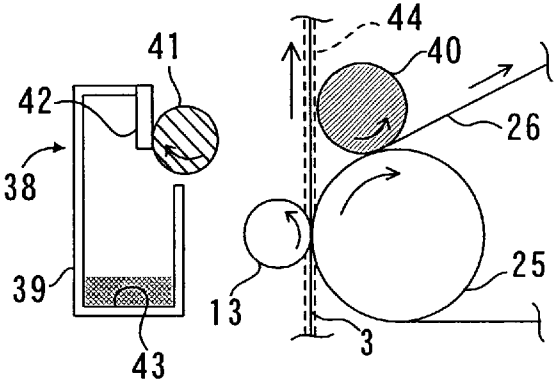

The control executed by the main drive control program will be described with reference to FIGS. 3A and 3B. FIGS. 3A and 3B show enlarged diagrams showing the area of the second cleaner 38.

In the color laser printer 1, first, a visible image is formed on the photosensitive belt 20 using the yellow toner and then transferred onto the intermediate transfer belt 26. Following this operation, a color-by-color visible image is formed on the photosensitive belt 20 using the magenta, cyan, and black toners and transferred onto the intermediate transfer belt 26, one by one, so that the toners overlap each other. Thus, a full-color image is formed on the intermediate transfer belt 26. While the above-described operation is performed (until the full-color image is formed on the intermediate transfer belt 26), as shown in FIG. 3A, the second cleaning roller 40 is located at the toner disposal position where the second cleaning roller 40 is out of contact with the intermediate transfer belt 26 and in contact with the second removing roller 41, in accordance with the control by the second cleaning roller moving mechanism 108.

In this state, the second cleaning roller 40 is in touch with the second removing roller 41. The second removing roller 41 is rotated in the clockwise direction by the main motor 105, so that the second cleaning roller 40 is rotated in the counterclockwise direction, following the second removing roller 41.

At that time, the second cleaning bias is not applied to the second cleaning roller 40 by the second cleaning bias applying circuit 110, so that the bias potential is 0 V.

On the other hand, the second removing bias is applied to the second removing roller 41 by the second removing bias applying circuit 107 and the bias potential is approximately −200 V.

When the toner held on the surface of the second cleaning roller 40 faces and contacts the second removing roller 41, the toner is electrically captured by the second removing roller 41 from the second cleaning roller 40 due to the potential difference between the second cleaning roller 40 and the second removing roller 41.

The toner, which adheres to the second removing roller 41, is wiped off by the second cleaning blade 42 by the rotation of the second removing roller 41 and drops under its own weight. Thus, the toner is stored in the waste toner storage portion 43.

At that time, the transfer roller 13 is located at the standby position and distanced from the intermediate transfer belt 26 by the transfer roller moving mechanism 103 as described above.

When the operation of forming the full-color image on the intermediate transfer belt 26 is complete, the second cleaning roller 40 is separated from the second removing roller 41 and moved to the cleaning position by the second cleaning roller moving mechanism 108.

The intermediate transfer belt 26 is rotated in the clockwise direction by the rotation of the first intermediate transfer belt roller 23 by the main motor 105, so that the second cleaning roller 40 rotates in the counterclockwise direction, following the intermediate transfer belt 26. The second cleaning bias is applied to the second cleaning roller 40 by the second cleaning bias applying circuit 110, and the bias potential is approximately −200 V.

At that time, the transfer roller 13 is located at the transfer position by the transfer roller moving mechanism 103 and in close proximity to the intermediate transfer belt 26. The transfer bias is applied to the transfer roller 13 by the transfer bias applying circuit 102. Therefore, the color image formed on the intermediate transfer belt 26 is transferred onto the sheet 3, which passes between the transfer roller 13 and the intermediate transfer belt 26.

After the color image on the intermediate transfer belt 26 is transferred onto the sheet 3, some toner may remain on the surface of the intermediate transfer belt 26. The toner, which remains on the surface of the intermediate transfer belt 26, is electrically captured by the second cleaning roller 40 due to the potential difference between the intermediate transfer belt 26 and the second cleaning roller 40 caused by the second cleaning bias applied to the second cleaning roller 40.

After the color image is transferred onto the sheet 3, as shown in FIG. 3A, the second cleaning roller 40 is moved to the toner disposal position to contact the second removing roller 41 by the second cleaning roller moving mechanism 108.

The application of the second cleaning bias to the second cleaning roller 40 is discontinued and the second removing bias of −200 V is applied to the second removing roller 41. Then, as described above, the toner, which adheres to the second cleaning roller 40, is electrically captured by the second removing roller 41. After that, the toner, which adheres to the second removing roller 41, is wiped off by the second cleaning blade 42 and stored in the waste toner storage portion 43.

As described above, in the color laser printer 1 of the first embodiment, the whole of the second cleaner 38 is not moved, but only the second cleaning roller 40 moves to contact and separate from the intermediate transfer belt 26 while the second cleaning box 39, the second removing roller 41 and the waste toner storage portion 43 are fixed. Further, the second cleaning roller 40 itself does not rotate on its own, but follows the rotation of the intermediate transfer belt 26. Thus, the second cleaning roller 40 is not connected with the drive mechanism. Accordingly, the structure of the color laser printer 1 can be simplified, thereby reducing its cost of manufacture.

The second cleaning roller 40 contacts the intermediate transfer belt 26 to capture toner thereon at the cleaning position shown in FIG. 3B. The second cleaning roller 40 also contacts the second removing roller 41 to remove the toner, which adheres to the second cleaning roller 40, at the toner disposal position shown in FIG. 3A when separated from the intermediate transfer belt 26.

As described above, the capture of the toner, which remains on the intermediate transfer belt 26, and the elimination of the toner, which adheres to the second cleaning roller 40, can be selectively performed only by changing the position of the second cleaning roller 40. Accordingly, the intermediate transfer belt 26 can be cleaned with a simple structure.

The intermediate transfer belt 26 is rotated by the main motor 105. The second cleaning roller 40 rotates, following the rotation of the intermediate transfer belt 26, when the second cleaning roller 40 is in contact with the intermediate transfer belt 26. Thus, there is no need to provide a mechanism for rotating the second cleaning roller 40 at the cleaning position. This results in a simplification of the structure and a cost reduction.

As described above, the second cleaning roller 40 is rotated following the intermediate transfer belt 26. Therefore, there are no variations in load of rotating the intermediate transfer belt 26 caused by the rotation of the second cleaning roller 40, so that variations in rotation speed of the intermediate transfer belt 26 can be suppressed. Thus, image quality can be improved.

While the second removing roller 41 is rotated by the main motor 105, the second cleaning roller 40 is rotated, following the second removing roller 41, when the second cleaning roller 40 contacts the second removing roller 41 at the toner disposal position. That is, it is unnecessary to provide a mechanism for rotating the second cleaning roller 40 at the toner disposal position. This results in a simplification of the structure and a cost reduction.

The second removing roller 41, the second cleaning blade 42 and the waste toner storage portion 43 are provided in the area that is opposite to the area where the intermediate transfer belt 26 is provided while sandwiching the sheet transfer path 44 of the sheet 3 therebetween. Therefore, the space in the casing 2 is effectively used, resulting in a further simplification of the structure and a space saving.

When the second cleaning roller 40 contacts the intermediate transfer belt 26, the second cleaning bias is applied to the second cleaning roller 40 by the second cleaning bias applying circuit 110. Thus, toner, which remains on the intermediate transfer belt 26, is electrically captured by the second cleaning roller 40 excellently.

When the second removing roller 41 contacts the second cleaning roller 40, the second removing bias is applied to the second removing roller 41 by the second removing bias applying circuit 107. Therefore, toner, which remains on the second cleaning roller 40, is electrically captured by the second removing roller 41 excellently.

The polymerized toner, which has a spherical shape and excellent mobility, is used in the embodiment. Generally, the diameter of the polymerized toner is smaller than that of ground toner. Accordingly, an image can be formed in high resolution and quality.

The polymerized toner has the excellent mobility, so that it is difficult to wipe the toner from the intermediate transfer belt 26 using a blade. However, in the color laser printer 1 of the embodiment, toner, which remains on the intermediate transfer belt 26, is electrically captured by the second cleaning roller 40, to which the second cleaning bias is applied. Then, the toner is electrically captured by the second removing roller 41, to which the second removing bias is applied. Therefore, even though the polymerized toner has the spherical shape and excellent mobility, the toner is surely removed from the intermediate transfer belt 26.

Figure 4A:
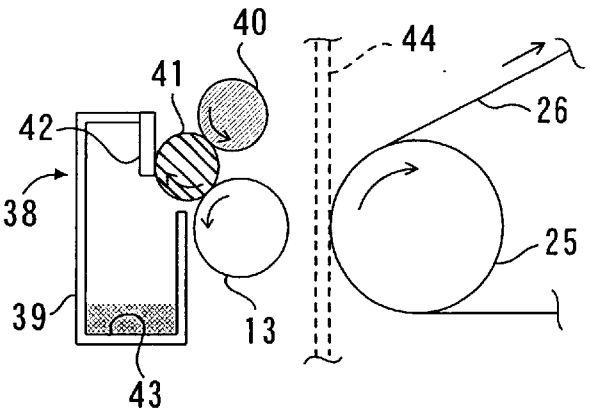
FIGS. 4A and 4B are diagrams showing the area of a second cleaner, of a second embodiment, for the color laser printer of FIG. 1.
Figure 4B:
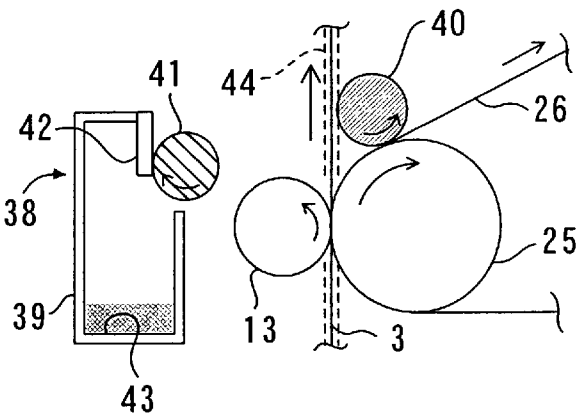

The second removing roller 41 can also serve as a roller for capturing toner, which adheres to the surface of the transfer roller 13. Referring to FIGS. 4A and 4B, this structure will be described as a second embodiment.

As shown in FIG. 4A, when the transfer roller 13 is located at the standby position and distanced from the intermediate transfer belt 26, the transfer roller 13 is in contact with the second removing roller 41 under the second cleaning roller 40.

Figure 5:
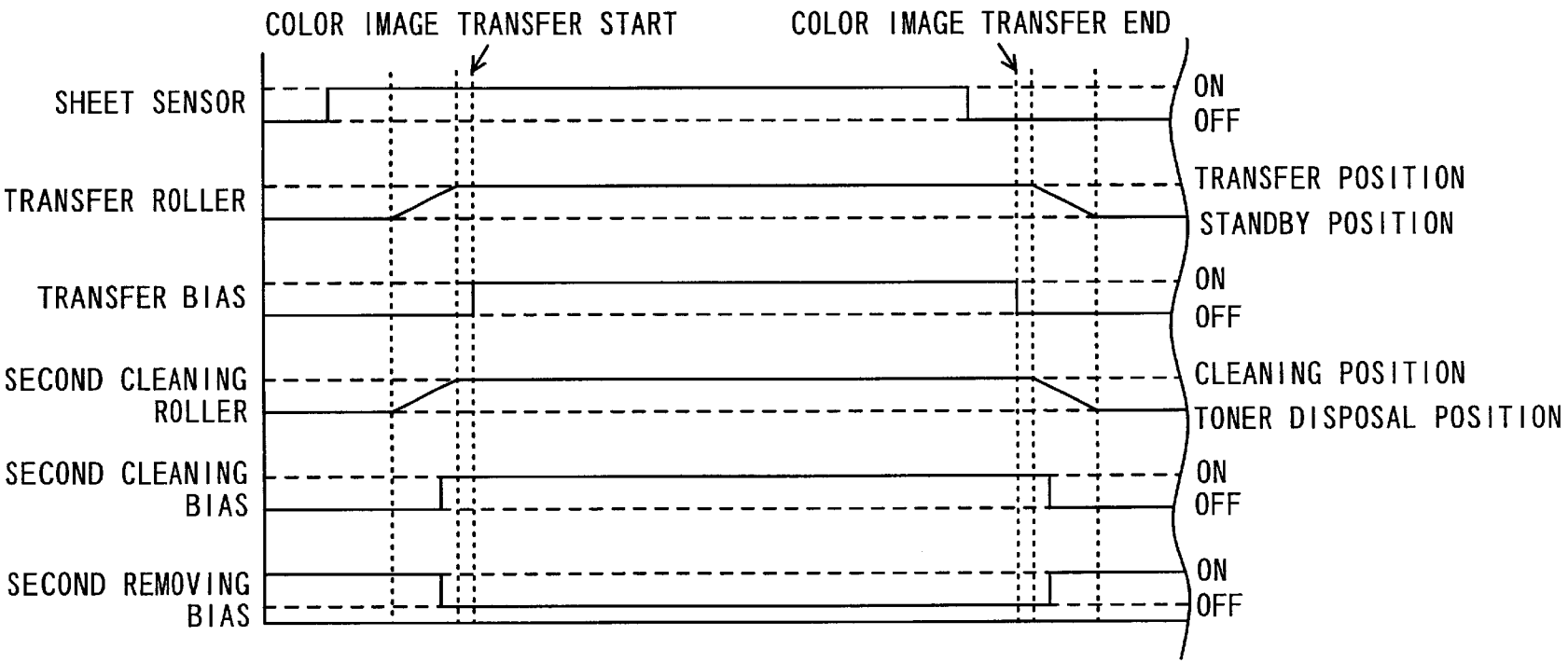
FIG. 5 is a timing chart showing operation of the color laser printer of FIGS. 4A and 4B.

Next, the movement control of the transfer roller 13 and the second cleaning roller 40 and the application control of the transfer bias, the second cleaning bias and the second removing bias will be described with reference to FIG. 5.

First, when printing processing starts, an electrostatic latent image is formed on the photosensitive belt 20 based on print data. A color-by-color visible image is sequentially formed and transferred onto the intermediate transfer belt 26, one by one, so the colors overlap one upon the other. Meanwhile, a sheet 3 is held by the resist rollers 9 and waits to be fed to the image forming unit 5, and the sheet sensor 32 is in an off state.

At that time, as shown in FIG. 4A, the transfer roller 13 is located at the standby position and is out of proximity to the intermediate transfer belt 26. The second cleaning roller 40 is placed at the toner disposal position and is also out of contact with the intermediate transfer belt 26. The transfer bias and the second cleaning bias are not applied to the transfer roller 13 and the second cleaning roller 40, respectively. Both the transfer roller 13 and the second cleaning roller 40 are in contact with the second removing roller 41.

The transfer roller 13 and the second removing roller 41 are rotated in the counterclockwise direction and in the clockwise direction, respectively, by the main motor 105. The second cleaning roller 40 is rotated in the counterclockwise direction, following the rotation of the second removing roller 41.

The second removing bias is applied to the second removing roller 41 by the second removing bias applying circuit 107 and the bias potential is approximately −200 V.

Therefore, in the state shown in FIG. 4A, toner, which remains on the transfer roller 13 and adheres to the second cleaning roller 40, are electrically captured by the second removing roller 41 due to the second removing bias applied to the second removing roller 41. The toner captured by the second removing roller 41 is wiped by the second cleaning blade 42 and stored in the waste toner storage portion 43.

When the visible images of all the colors are transferred onto the intermediate transfer belt 26 from the photosensitive belt 20 and a full-color image is formed, the resist rollers 9 rotate to feed the sheet 3 to the image forming unit 5. When the leading edge of the sheet 3 passes the sheet sensor 32, as shown in FIG. 5, the sheet sensor 32 starts the output of detection signals.

By the time the sheet 3 reaches a position where the intermediate transfer belt 26 and the transfer roller 13 face each other (which is referred to as a transfer position in FIG. 5) after the sheet sensor 32 starts the output, the transfer roller 13 is moved to the transfer position by the transfer roller moving mechanism 103 so as to be opposite to the intermediate transfer belt 26, as shown in FIG. 4B. At the same time, the second cleaning roller 40 is moved to the cleaning position by the second cleaning roller moving mechanism 108.

While the transfer roller 13 and the second cleaning roller 40 are moved to the respective positions, the second cleaning bias is applied to the second cleaning roller 40 by the second cleaning bias applying circuit 110 and the application of the second removing bias to the second removing roller 41 is discontinued by the second removing bias applying circuit 107. The potential of the second cleaning bias is approximately −200 V.

When the sheet 3 reaches the transfer position of the transfer roller 13 after the transfer roller 13 moves proximate to the intermediate transfer belt 26 at the transfer position and the second cleaning roller 40 contacts the intermediate transfer belt 26 at the cleaning position, the transfer bias of approximately between −1 KV and −2 KV is applied to the transfer roller 13 by the transfer bias applying circuit 102. Thus, the color image is transferred onto the sheet 3 from the intermediate transfer belt 26.

While the color image is transferred onto the sheet 3, the toner, which remains on the intermediate transfer belt 26, is captured by the second cleaning roller 40 due to the action of the second cleaning bias applied to the second cleaning roller 40.

After a predetermined period of time has elapsed after the trailing edge of the sheet 3 passes the sheet sensor 32 and the sheet sensor 32 takes the off state, an operation for ending the transfer of the color image onto the sheet 3 is performed.

First, the application of the transfer bias is discontinued by the transfer bias applying circuit 102. Then, the transfer roller 13 is moved away from, or separated from, the intermediate transfer belt 26 to be moved from the transfer position to the standby position by the transfer roller moving mechanism 103.

At that time, the second cleaning roller 40 is also separated from the intermediate transfer belt 26 to be moved from the cleaning position to the toner disposal position by the second cleaning roller moving mechanism 108.

While the transfer roller 13 and the second cleaning roller 40 are moved to the respective positions, the application of the second cleaning bias to the second cleaning roller 40 is discontinued by the second cleaning bias applying circuit 110 and the second removing bias is applied to the second removing roller 41 by the second removing bias applying circuit 107.

Thus, as shown in FIG. 4A, the transfer roller 13 and the second cleaning roller 40 are located at the standby position and at the toner disposal position, respectively. Because the second removing bias is applied to the second removing roller 41, the toner, which adheres to the transfer roller 13 and the second cleaning roller 40, are electrically captured by the second removing roller 41.

Then, the toner captured by the second removing roller 41 is wiped by the second cleaning blade 42 and stored in the waste toner storage portion 43.

As described above, in the second embodiment shown in FIGS. 4A and 4B, the second removing roller 41 also serves as the roller for capturing toner adhering to the transfer roller 13. Accordingly, it is unnecessary to provide a special roller for capturing toner adhering to the transfer roller 13. This results in a simplification of the structure.

In the second embodiment, the transfer roller 13 contacts the intermediate transfer belt 26 via the sheet 3 when the second cleaning roller 40 is in contact with the intermediate transfer belt 26. Therefore, the transfer of the color image from the intermediate transfer belt 26 to the sheet 3 can be concurrently performed with the capture of the toner remaining on the intermediate transfer belt 26.

Further, when the transfer roller 13 contacts the second removing roller 41, the second cleaning roller 40 also contacts the second removing roller 41. At that time, both the transfer roller 13 and the second cleaning roller 40 are separated from proximity to the intermediate transfer belt 26. Accordingly, the elimination of the toner, which adheres to the transfer roller 13 and the second cleaning roller 40, can be performed at the same time. Thus, the toner can be further effectively captured and removed from the transfer roller 13 and the second cleaning roller 40.

In the second embodiment, while the second cleaning roller 40 is in contact with the intermediate transfer belt 26, the second cleaning bias of −200 V is applied to the second cleaning roller 40 by the second cleaning bias applying circuit 110. Thus, the toner, which remains on the intermediate transfer belt 26, is excellently captured.

While the second removing roller 41 is in contact with the second cleaning roller 40 and the transfer roller 13, the second removing bias of −200 V is applied to the second removing roller 41 by the second removing bias applying circuit 107. Thus, the toner, which adheres to the second cleaning roller 40 and the transfer roller 13, is excellently removed.

Figure 6B:
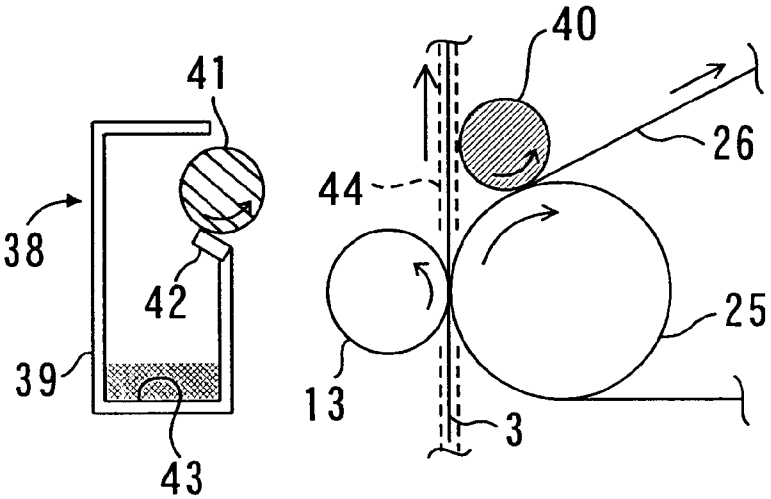
FIGS. 6A and 6B are diagrams showing the area of a second cleaner, of a third embodiment, for the color laser printer of FIG. 1.
Figure 6A:
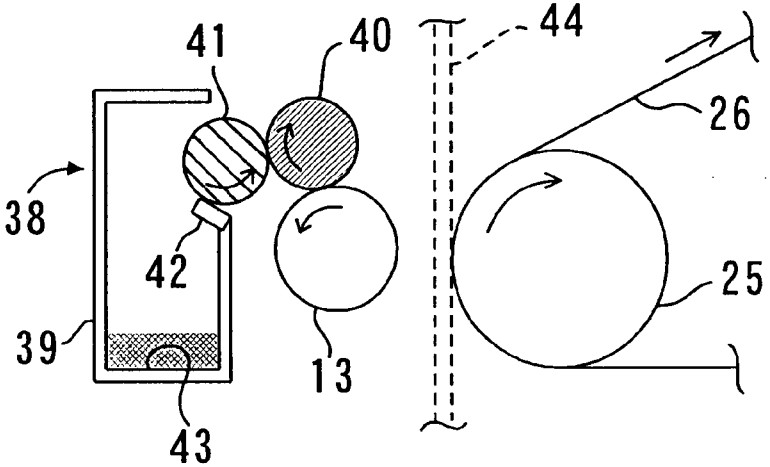

The second cleaning roller 40 can be also serve as a roller for capturing toner, which adheres to the surface of the transfer roller 13. Referring to FIGS. 6A and 6B, this structure will be described as a third embodiment.

As shown in FIG. 6A, the second cleaning blade 42 is provided so as to urge the second removing roller 41 from below. The second cleaning blade 42 is disposed so as to be opposite to the second cleaning roller 40, sandwiching the second removing roller 41 therebetween. The transfer roller 13 is designed so as to contact the second cleaning roller 40 from below when the transfer roller 13 is separated from proximity to the intermediate transfer belt 26.

Figure 7:
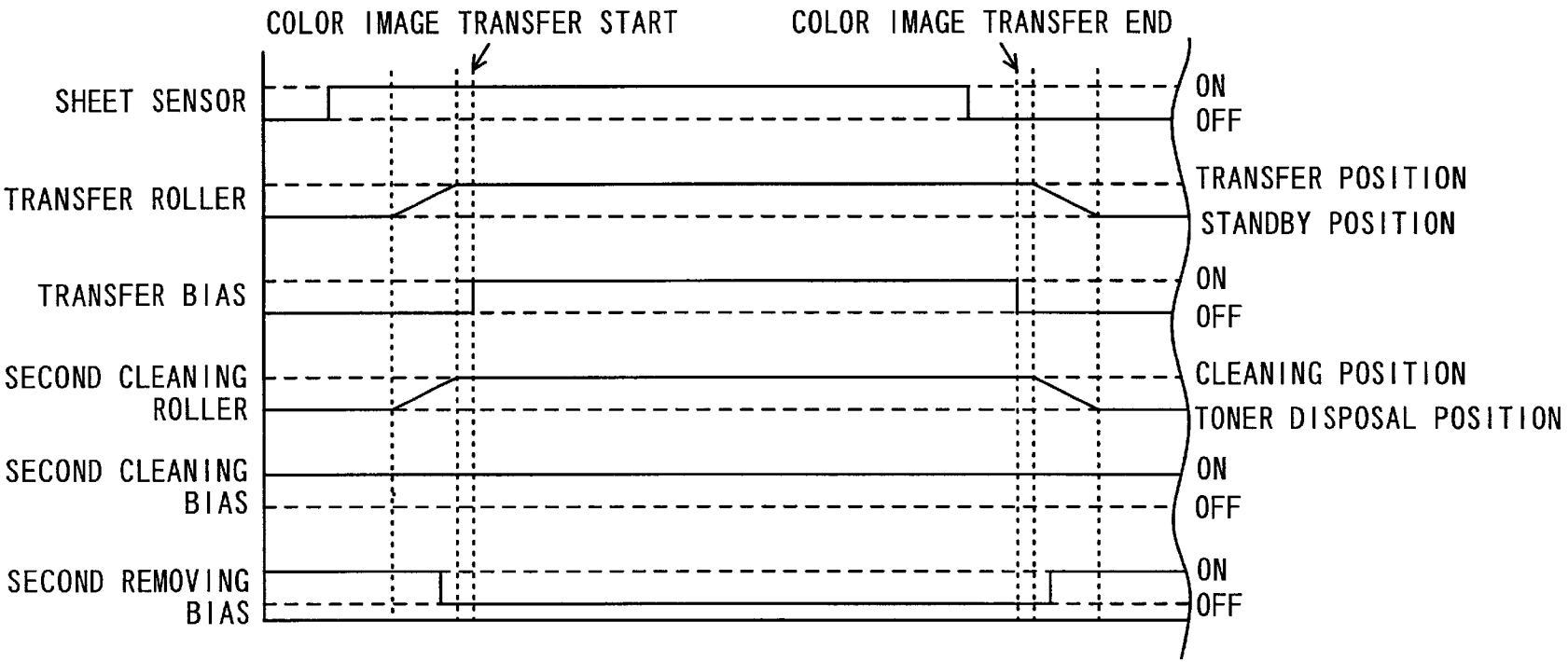
FIG. 7 is a timing chart showing operation of the color laser printer of FIGS. 6A and 6B.

Next, the movement control of the transfer roller 13 and the second cleaning roller 40 and the application control of the transfer bias, the second cleaning bias and the second removing bias will be described with reference to FIG. 7.

First, when printing processing starts, an electrostatic latent image is formed on the photosensitive belt 20 based on print data. A color-by-color visible image is sequentially formed and transferred onto the intermediate transfer belt 26 one by one so as to overlap one upon the other. Meanwhile, a sheet 3 is held by the resist rollers 9 and waits to be fed to the image forming unit 5, and the sheet sensor 32 is in the off state.

At that time, as shown in FIG. 6A, the second cleaning roller 40 is located at the toner disposal position where the second cleaning roller 40 contacts a side of the second removing roller 41. In this position, the second cleaning roller 40 is out of contact with the intermediate transfer belt 26. The second cleaning bias of approximately −200 V is applied to the second cleaning roller 40.

The transfer roller 13 is located at the standby position. At this position, the transfer roller 13 is in contact with the second cleaning roller 40 from below and is separated from proximity to the intermediate transfer belt 26. The transfer bias is not applied to the transfer roller 13.

The transfer roller 13 and the second removing roller 41 are rotated in the counterclockwise direction by the main motor 105. The second cleaning roller 40 is rotated in the clockwise direction, following the rotation of the second removing roller 41 and the transfer roller 13.

The second removing bias is applied to the second removing roller 41 by the second removing bias applying circuit 107. The bias potential is approximately 400 V.

Therefore, in the state shown in FIG. 6A, the toner, which adheres to the transfer roller 13, is electrically captured by the second cleaning roller 40 by the action of the second cleaning bias applied thereto.

Then the toner, which adheres to the second cleaning roller 40, is electrically captured by the second removing roller 41 by the action of the second removing bias applied to the second removing roller 41.

The toner captured by the second removing roller 41 is wiped by the second cleaning blade 42 and stored in the waste toner storage portion 43.

When the visible images of all the colors are transferred onto the intermediate transfer belt 26 from the photosensitive belt 20 and a full-color image is formed, the resist rollers 9 rotate to feed the sheet 3 to the image forming unit 5. When the leading edge of the sheet 3 passes the sheet sensor 32, as shown in FIG. 7, the sheet sensor 32 starts the output of detection signals.

By the time the sheet 3 reaches a position where the intermediate transfer belt 26 and the transfer roller 13 face each other (which is referred to as a transfer position in FIG. 7) after the sheet sensor 32 starts the output, the transfer roller 13 is moved to the transfer position by the transfer roller moving mechanism 103 so as to be opposite to the intermediate transfer belt 26 as shown in FIG. 6B. At that time, the second cleaning roller 40 is moved to the cleaning position by the second cleaning roller moving mechanism 108.

When the transfer roller 13 and the second cleaning roller 40 are moved to the respective positions, the application of the second removing bias to the second removing roller 41 is discontinued by the second removing bias applying circuit 107 while the second cleaning bias continues to be applied to the second cleaning roller 40. In the third embodiment, as shown in FIG. 7, the second cleaning bias of −200 V is applied to the second cleaning roller 40 at all times.

When the sheet 3 reaches the transfer position of the transfer roller 13, after the transfer roller 13 is proximate the intermediate transfer belt 26 at the transfer position and the second cleaning roller 40 contacts the intermediate transfer belt 26 at the cleaning position, the transfer bias of approximately between −1 KV and −2 KV is applied to the transfer roller 13 by the transfer bias applying circuit 102. Thus, the color image is transferred onto the sheet 3 from the intermediate transfer belt 26.

As the color image is transferred onto the sheet 3, the toner, which remains on the intermediate transfer belt 26, is captured by the second cleaning roller 40 by the action of the second cleaning bias applied to the second cleaning roller 40.

When a predetermined period of time has elapsed after the trailing edge of the sheet 3 passes the sheet sensor 32 and the sheet sensor 32 takes the off state, an operation for ending the transfer of the color image onto the sheet 3 is performed.

First, the application of the transfer bias to the transfer roller 13 is discontinued by the transfer bias applying circuit 102. Then, the transfer roller 13 is separated from proximate the intermediate transfer belt 26, i.e., moved from the transfer position to the standby position by the transfer roller moving mechanism 103.

At that time, the second cleaning roller 40 is separated from the intermediate transfer belt 26 and moved from the cleaning position to the toner disposal position by the second cleaning roller moving position 108.

As the transfer roller 13 and the second cleaning roller 40 are moved to the respective positions, the second removing bias is applied to the second removing roller 41 by the second removing bias applying circuit 107.

As described above, as shown in FIG. 6A, the transfer roller 13 and the cleaning roller 40 are then located at the standby position and at the toner disposal position, respectively. Because the second cleaning bias is applied to the second cleaning roller 40, the toner, which adheres to the transfer roller 13, is electrically captured by the second cleaning roller 40.

The toner, which is captured by the second cleaning roller 40 from the intermediate transfer belt 26 and the transfer roller 13, is electrically captured by the second removing roller 41 by the action of the second removing bias applied to the second removing roller 41.

Then, the toner captured by the second removing roller 41 is wiped by the second cleaning blade 42 and stored in the waste toner storage portion 43.

As described above, in the third embodiment shown in FIGS. 6A and 6B, the second cleaning roller 40 also serves as the roller for capturing the toner which adheres to the transfer roller 13. Therefore, it is unnecessary to provide a special roller for capturing the toner adhering to the transfer roller 13. This results in a simplification of the structure.

In the third embodiment, when the second cleaning roller 40 is in contact with the intermediate transfer belt 26, the transfer roller 13 is proximate the intermediate transfer belt 26 with the sheet 3 passing therebetween. Accordingly, the transfer of the color image from the intermediate transfer belt 26 to the sheet 3 can be concurrently performed with the capture of the toner remaining on the intermediate transfer belt 26.

When the second cleaning roller 40 is in contact with the second removing roller 41 while separated from the intermediate transfer belt 26, the transfer roller 13 is also in contact with the second cleaning roller 40 while separated from proximate the intermediate transfer belt 26. Therefore, the elimination of the toner, which adheres to the second cleaning roller 40 and the transfer roller 13, can be performed at the same time. Accordingly, the waste toner can be further effectively removed from the transfer roller 13 and the second cleaning roller 40.

In the third embodiment, when the second cleaning roller 40 is in contact with the intermediate transfer belt 26, the second cleaning bias of −200 V is applied to the second cleaning roller 40. Thus, the toner, which remains on the intermediate transfer belt 26, is excellently removed.

When the second cleaning roller 40 is in contact with the second removing roller 41 and the transfer roller 13, the second cleaning bias of −200 V is also applied to the second cleaning roller 40 by the second cleaning bias applying circuit 110. Further, when the second removing roller 41 is in contact with the second cleaning roller 40, the second removing bias of −400 V is applied to the second removing roller 41 by the second removing bias applying circuit 107.

Accordingly, the toner, which adheres to the second cleaning roller 40 and the transfer roller 13, is excellently removed.

In the above-described embodiments, positively charged toner is used. However, negatively charged toner can be used. In this case, the polarity of the transfer bias, the cleaning bias and the removing bias is reversed to that used in the above-described embodiments.

While the invention has been described in detail and with reference to the specific embodiments thereof, it would be apparent to those skilled in the art that various changes, arrangements and modifications may be applied therein without departing from the spirit and scope of the invention.

What is claimed is:

1. An image forming apparatus, comprising:

a developer cartridge that contains developer;

an image holding element that holds the developer to form a visible image, the developer being supplied from the developer cartridge;

an intermediate transfer element on which the visible image is transferred;

a cleaning element that captures the developer from the intermediate transfer element;

a removing member that removes the developer from the cleaning element;

a mechanism that moves the cleaning element so as to contact and separate from the intermediate transfer element and to contact and separate from the removing members; and a developer container that contains the developer removed by the removing member, the developer container and the removing member being opposite to the intermediate transfer element at a sheet transfer path.

2. The image forming apparatus according to claim 1, wherein the mechanism moves the cleaning element between a first position where the cleaning element contacts the removing member and is separate from the intermediate transfer element and a second position where the cleaning element contacts the intermediate transfer element and is separate from the removing member.

3. The image forming apparatus according to claim 1, wherein the intermediate transfer element is driven by a driving element, the cleaning element being a follower of the intermediate transfer element.

4. The image forming apparatus according to claim 1, wherein the removing member is driven by a driving element, the cleaning element being a follower of the removing member.

5. The image forming apparatus according to claim 1, wherein a cleaning bias is applied to the cleaning element when the cleaning element contacts the intermediate transfer element.

6. The image forming apparatus according to claim 5, wherein a removing bias is applied to the removing member when the cleaning element contacts the removing member.

7. The image forming apparatus according to claim 1, further comprising a transfer member that transfers the visible image from the intermediate transfer element to a sheet, wherein the removing member captures the developer from the transfer member.

8. The image forming apparatus according to claim 7, wherein the transfer member is moved between positions close to and away from the intermediate transfer element.

9. The image forming apparatus according to claim 8, wherein the transfer member is at the position close to the intermediate transfer element when the cleaning element contacts the intermediate transfer element.

10. The image forming apparatus according to claim 9, wherein the transfer member is at the position away from the intermediate transfer element and contacts the removing member when the cleaning element contacts the removing member.

11. The image forming apparatus according to claim 10, wherein a cleaning bias is applied to the cleaning element when the cleaning element contacts the intermediate transfer element.

12. The image forming apparatus according to claim 10, wherein a removing bias is applied to the removing member when the removing member contacts the cleaning element and the transfer member.

13. The image forming apparatus according to claim 1, further comprising a transfer member that transfers the visible image from the intermediate transfer element to a sheet, wherein the cleaning element captures the developer from the transfer member.

14. The image forming apparatus according to claim 13, wherein the transfer member is moved to positions close to and away from the intermediate transfer element.

15. The image forming apparatus according to claim 14, wherein the transfer member is at the position close to the intermediate transfer element when the cleaning element contacts the intermediate transfer element.

16. The image forming apparatus according to claim 15, wherein the transfer member is at the position away from the intermediate transfer element and contacts the cleaning element when the cleaning element contacts the removing member.

17. The image forming apparatus according to claim 16, wherein a cleaning bias is applied to the cleaning element when the cleaning element contacts the intermediate transfer element and the transfer member.

18. The image forming apparatus according to claim 16, wherein a removing bias is applied to the removing member when the removing member contacts the cleaning element.

19. An image forming apparatus, comprising:

a developer cartridge that contains developer;

an image holding element that holds the developer to form a visible image, the developer being supplied from the developer cartridge;

an intermediate transfer element on which the visible image is transferred;

a cleaning element that captures the developer from the intermediate transfer element;

a removing member that removes the developer from the cleaning element;

a mechanism that moves the cleaning element so as to contact and separate from the intermediate transfer element and to contact and separate from the removing member; and a transfer member that transfers the visible image from the intermediate transfer element to a sheet, wherein the removing member captures the developer from the transfer member.

20. The image forming apparatus according to claim 19, wherein the transfer member is moved between positions close to and away from the intermediate transfer element.

21. The image forming apparatus according to claim 20, wherein the transfer member is at the position close to the intermediate transfer element when the cleaning element contacts the intermediate transfer element.

22. The image forming apparatus according to claim 21, wherein the transfer member is at the position away from the intermediate transfer element and contacts the removing member when the cleaning element contacts the removing member.

23. The image forming apparatus according to claim 22, wherein a cleaning bias is applied to the cleaning element when the cleaning element contacts the intermediate transfer element.

24. The image forming apparatus according to claim 23, wherein a removing bias is applied to the removing member when the removing member contacts the cleaning element and the transfer member.

25. An image forming apparatus, comprising:

a developer cartridge that contains developer;

an image holding element that holds the developer to form a visible image, the developer being supplied from the developer cartridge;

an intermediate transfer element on which the visible image is transferred;

a cleaning element that captures the developer from the intermediate transfer element;

a removing member that removes the developer from the cleaning element;

a mechanism that moves the cleaning element so as to contact and separate from the intermediate transfer element and to contact and separate from the removing member; and a transfer member that transfers the visible image from the intermediate transfer element to a sheet, wherein the cleaning element captures the developer from the transfer member.

26. The image forming apparatus according to claim 25, wherein the transfer member is moved to positions close to and away from the intermediate transfer element.

27. The image forming apparatus according to claim 26, wherein the transfer member is at the position close to the intermediate transfer element when the cleaning element contacts the intermediate transfer element.

28. The image forming apparatus according to claim 27, wherein the transfer member is at the position away from the intermediate transfer element and contacts the cleaning element when the cleaning element contacts the removing member.

29. The image forming apparatus according to claim 28, wherein a cleaning bias is applied to the cleaning element when the cleaning element contacts the intermediate transfer element and the transfer member.

30. The image forming apparatus according to claim 28, wherein a removing bias is applied to the removing member when the removing member contacts the cleaning element.

* * * * *